US005403025A

United States Patent [19]

Shanley

[11] Patent Number: 5,403,025

[45] Date of Patent: Apr. 4, 1995

[54] PARTIALLY PREPRINTED, SERVICE INVOICE RECORD FORMS, HAVING PIGGYBACK VINYL STATIC CLING CUSTOMER SERVICE INFORMATION

[76] Inventor: Thomas M. Shanley, 19908 NE. 129th St., Woodinville, Wash. 98072

[21] Appl. No.: 206,383

[22] Filed: Mar. 3, 1994

[51] Int. Cl.[6] ..... B42D 15/00

[52] U.S. Cl. ..... 283/81; 283/79; 283/107

[58] Field of Search ..... 283/81, 107, 79, 74, 283/100, 101, 55; 281/21.1, 15.1; 40/299.

[56] References Cited

U.S. PATENT DOCUMENTS

| | | | |
|---|---|---|---|
| 2,177,627 | 10/1939 | Drew | 283/81 X |
| 4,562,102 | 12/1985 | Rabuse et al. | 281/21.1 |
| 5,102,171 | 11/1992 | Saetre | 283/117 |
| 5,259,648 | 11/1993 | Gerber | 283/81 |
| 5,324,078 | 6/1994 | Bane | 283/81 |

*Primary Examiner*—Willmon Fridie
*Attorney, Agent, or Firm*—Roy E. Mattern, Jr.

[57] ABSTRACT

Personnel of vehicle and equipment service organizations, at the start, during, and completion, of the services, use a partially preprinted service invoice record form, having a piggyback vinyl static cling customer service information label secured to it, to completely machine print all the added service information, inclusive of machine print entered on this piggyback vinyl static cling customer service information label, which is later peeled away and then placed, for example, on the windshield of a vehicle. The overall manufacturing operations, to produce this product for service organizations, commence with a manufacturing process to create a source, preferably a roll source, of a three lamination stock of material. The resulting laminations are: an eight millimeter layer of vinyl static cling material; laminated on top of a two millimeter layer of polyester material, which has an adhesive coating on its opposing side to its side which is receiving the vinyl static cling material lamination.

19 Claims, 4 Drawing Sheets

PARTIALLY PREPRINTED, SERVICE INVOICE RECORD FORMS, HAVING PIGGYBACK VINYL STATIC CLING CUSTOMER SERVICE INFORMATION

BACKGROUND

In the past and currently, vinyl static cling customer service information labels, to be used by personnel, for example, of vehicle and equipment service organizations, especially for example, by personnel at automotive service centers, are provided by material manufacturers, who manufacture them by laminating the vinyl static cling material to a coated material, and these two materials are held in their relative positions by the presence of a static charge. This two layer laminated vinyl static cling customer service information label, so remains as two laminations, via selected marketing channels, until reaching a service organization, where the person performing the service makes his or her generally hand written entries on the vinyl static cling customer service information label, and then removes the coated material and applies only this vinyl cling label to the glass surface, or the like, such as the windshield of a customer's vehicle.

The correlation of the entire preparation and keeping of service records, inclusive of the correct correlation and keeping a record of the information written generally by hand on this vinyl static cling customer service information label, requires a great deal of effort by all the personnel concerned at a service organization. This effort is considered cumbersome and there are times when erroneous information is documented, especially in reference to the manual transposition process of the important service information.

When personnel of vehicle and equipment service organizations start and complete the services requested and needed to keep a vehicle or equipment in excellent running condition, this manufactured partially preprinted service invoice record form, having a piggyback vinyl static cling customer service information label secured to it, is used, so all pertinent important service information is completely machine printed, inclusive of the service information on the finally removed piggyback vinyl static cling customer service information label. Thereafter, this service information label is placed on the customer's vehicle or equipment, by the service personnel, giving the customer the essential informational data regarding the completed service and/or the future service.

The first manufacturing process of several involves the making of the piggyback vinyl static cling stock. An eight (8) millimeter layer of vinyl static cling material is laminated on top of a two (2) millimeter layer of polyester material, and is held in place by a static electrical charge. Then this two (2) millimeter layer of polyester material has an adhesive coating applied on its side, opposite to its side which has received the vinyl static cling material lamination. Thereafter, a layer of three (3) millimeter paper liner has a contact side thereof impregnated with silicone, and this contact side is pressed against the adhesive coating of the two (2) millimeter layer of polyester material, completing these three layers of materials, which form the piggyback vinyl static cling stock. The presence of the silicone later facilitates the release of the two (2) millimeter layer of polyester material and the vinyl static cling material from this three (3) millimeter paper liner, during a subsequent manufacturing process. The three laminated layers of materials are preferably arranged in rolls having lengths and widths specified with respect to end product specifications.

The second manufacturing process preferably involves progressively removing the piggyback vinyl static cling stock from a respective pre-manufactured roll, rather than receiving it directly, and feeding this stock through a manufacturing line, centering on printing presses and related equipment, to modify this stock to create customer service information labels. This is done by printing information on one side, printing a copy matte coating in a selected shape area at a selected location on each customer's service information label, creating cuts arranged both in the direction of the length of the piggyback vinyl static cling stock, and in the transverse direction across the piggyback vinyl static cling stock, only in the top two laminations, and then re-rolling this preprinted and formed piggyback vinyl static cling stock. Preferably, the trimmed away materials are rolled up for convenient handling.

The third manufacturing process involves the operation of a blow-on machine. Respective, previously prepared via a printing process, partially preprinted service organization service invoice record forms, preferably fan folded, are supplied to the blow-on machine. Also, the preferable roll of the preprinted and formed piggyback vinyl static cling stock is supplied to the blow-on machine. Thereafter this blow-on machine is operated to remove the combined layers of the eight (8) millimeter layer of vinyl static cling material on the two (2) millimeter layer of polyester material having the adhesive coating, from the three (3) millimeter paper liner, which has served as a carrier paper liner. This convenient separation is facilitated by the presence of the impregnated silicone. Then these combined layers, in their respective customer service informational label sizes, are blown on the respective partially preprinted service organization service invoice record forms, where they remain through the utilization of the adhesive coating on the polyester material. Thereafter, these forms are fan folded and delivered to service organizations, completing the manufacturing processes.

The last process is a utilization process, centering on machine printing. At the service organization, the personnel load the fan folded forms into their invoice printer, and thereafter, on demand, when services are being rendered, he or she completes the respective printing of each customer service invoice, having the piggyback vinyl static cling service information label, which is likewise machine printed at the completion of the service to the vehicle or equipment of the customer. There are no hand entries of data made by the personnel. Thereafter, the vinyl static cling service information label is peeled from the two (2) millimeter layer of polyester material, which remains adhered to the invoice record forms, completing its carrier function, and is placed, for example, on the windshield of a vehicle, which has been serviced, to be conveniently and quickly observed by the owner or operator of the vehicle or equipment to give her or him the important service data, whenever the operator or owner wants to refer to this important data.

DRAWINGS

Preferred embodiments of the products and processes pertaining to piggyback vinyl static cling customer service information label stock, the labels made therefrom, and their arrangement on service invoice record forms, used by personnel of vehicle and equipment service organizations, are illustrated in the drawings, wherein:

FIG. 1 is a perspective view of a preferred roll supply of piggyback vinyl static cling customer's service information label stock, showing, for illustrative purposes, the three laminations being separated, in part, which during the first manufacturing process are laminated together and rolled up, wherein, during the process, a eight millimeter layer of vinyl static cling material is laminated on top of a two millimeter layer of polyester material, having an adhesive coating on its opposite side, and a static electrical charge keeps these two laminations on their relative positions, as they are laminated to a three millimeter paper carrier liner, which first has its contact surface impregnated with silicone to facilitate its later release from the adhesive coating on the polyester material;

FIG. 2, is an overview of the manufacturing process, wherein a preferred roll supply of piggyback vinyl static cling customer service information label stock is mounted in a manufacturing line, centering on printing presses and related equipment, shown in a side view format, whereby this stock is unrolled and modified to create customer's service labels, and this is done, as shown in respective related top view format of this overview, by printing information on one side, printing a copy matte coating in a selected shape area at a selected location, on this same side, of each prospective customer's service information label, being further processed by creating cuts arranged both in the longitudinal and transverse directions, only in the top two laminations, i.e. the vinyl and polyester materials, and then, preferably, rerolling this preprinted and formed piggyback vinyl static cling stock, and also preferably rolling up the cut away trimmed away excess materials for their convenient handling;

FIG. 3 is an overview of the manufacturing process, wherein the preferred roll supply of the preprinted and formed piggyback vinyl cling stock is mounted on a blow-on machine, shown in a side view format, and also manufactured, partially preprinted, service invoice record forms of a vehicle or equipment service organization, preferably fan folded, are mounted on the blow-on machine, then this machine is operated to separate the top two laminations of vinyl and polyester materials, which are then the various formed customer service labels, from the paper carrier lamination, aided by the impregnated silicone, and then these labels are individually blown in place on the service invoice record forms, as shown in the respective before and after related top view formats of this overview, and thereafter the service invoice record forms with the customer service information labels are preferably fan folded for delivery to a service organization; and FIG. 4 is an overview of how personnel of vehicle and equipment service organizations utilize the preferably fan folded service invoice record forms, with the customer service information labels thereon, in their printer, to complete the mechanical printing of all the service information on both the service invoice record form and the customer service information label, as shown in the related top view format of this overview, showing this final printing, and then as indicated the customer service information label is peeled free of the polyester material, which remains with the invoice, and thereafter placed, for example, as shown in related perspective view format of this overview, on the windshield of the customer's car.

DESCRIPTION OF THE PREFERRED EMBODIMENTS

Introduction

Figure 4:
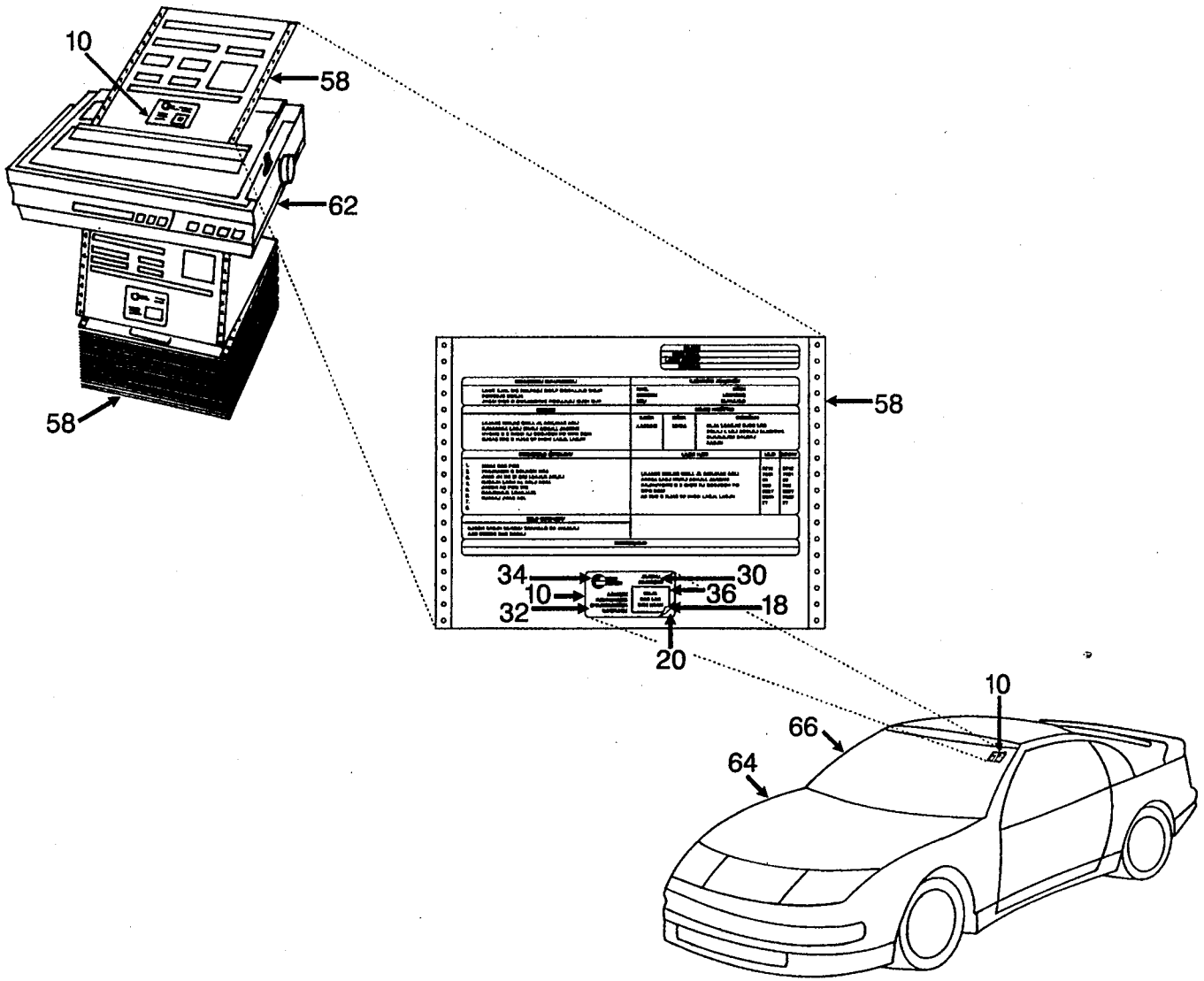

As shown in the overview of FIG. 4, piggyback vinyl static cling customer service information labels 10, electro-statically clinging to their respective polyester carriers 20, by virtue of the use of this clear vinyl lamination material 18 and its charge, are as two laminations, adhesively secured, by such a coating on the polyester carrier 20, to respective partially preprinted service invoice record forms 16. These forms 16 are then used by personnel of a vehicle or equipment service organization, to completely print both this invoice form 16 and the piggyback vinyl static cling customer service information label 10 at a service time. Thereafter, the piggyback vinyl static cling customer service information 10, is peeled off the polyester carrier material 20, no longer being in its piggyback status, and is placed, for example, on the windshield of a vehicle.

Figure 1:
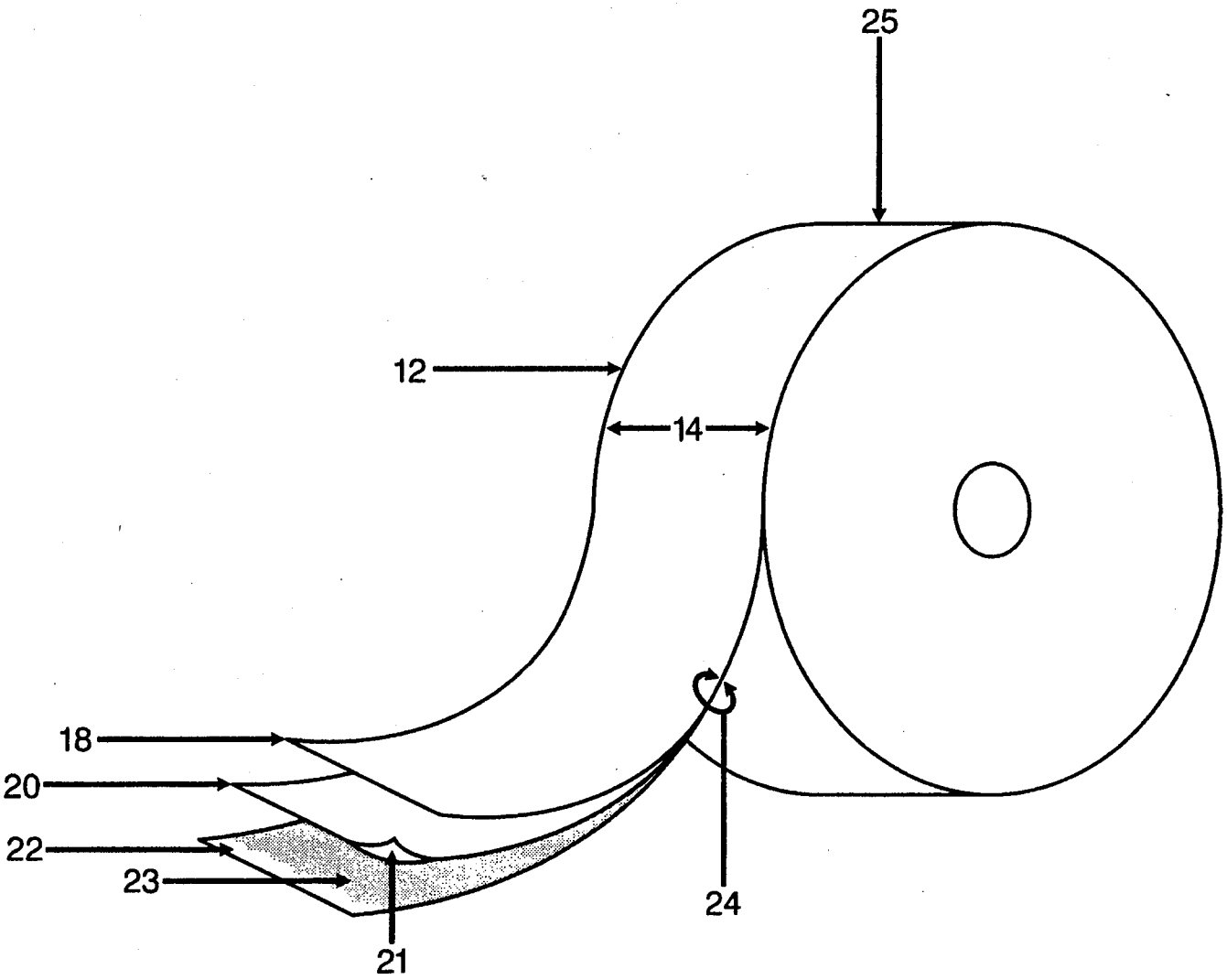

The piggyback vinyl static cling stock 24, illustrated in FIG. 1, in a preferred roll 25, is, as indicated, manufactured from three materials into this roll of a specified length and width which become three respective laminations of this stock 24. One lamination is the clear vinyl material 18. A second lamination is a polyester material 20 having a smooth surface to receive the electro-statically charged vinyl material 18, and having its opposite surface or side coated with an adhesive material 21. The third lamination is a paper material 22, also referred to as a paper liner 22, having a top surface impregnated with silicone 23, so this impregnated surface which is laminated against the polyester material 20, may later be conveniently separated from the adhesive material 21.

Figure 2:
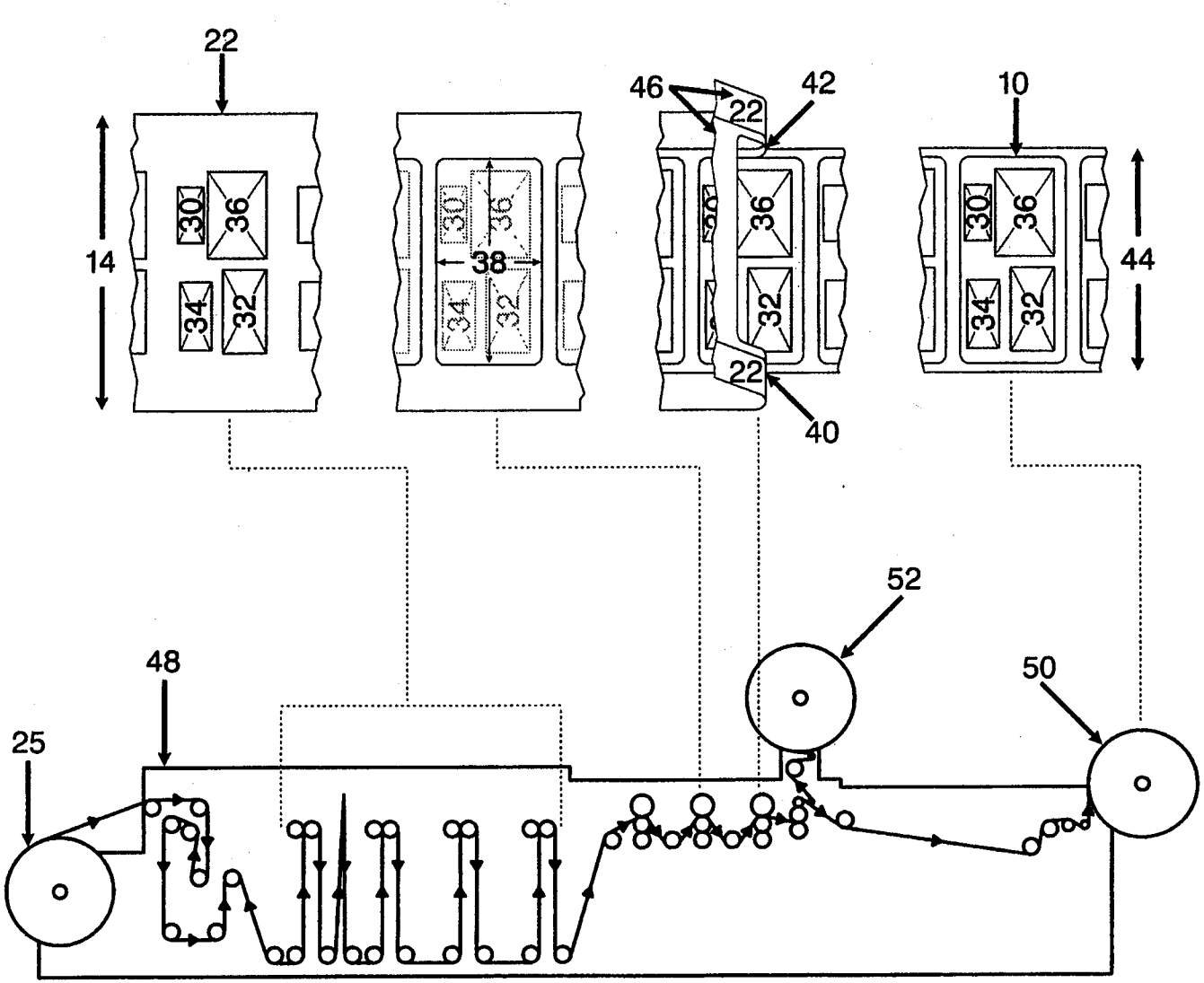
Figure 3:
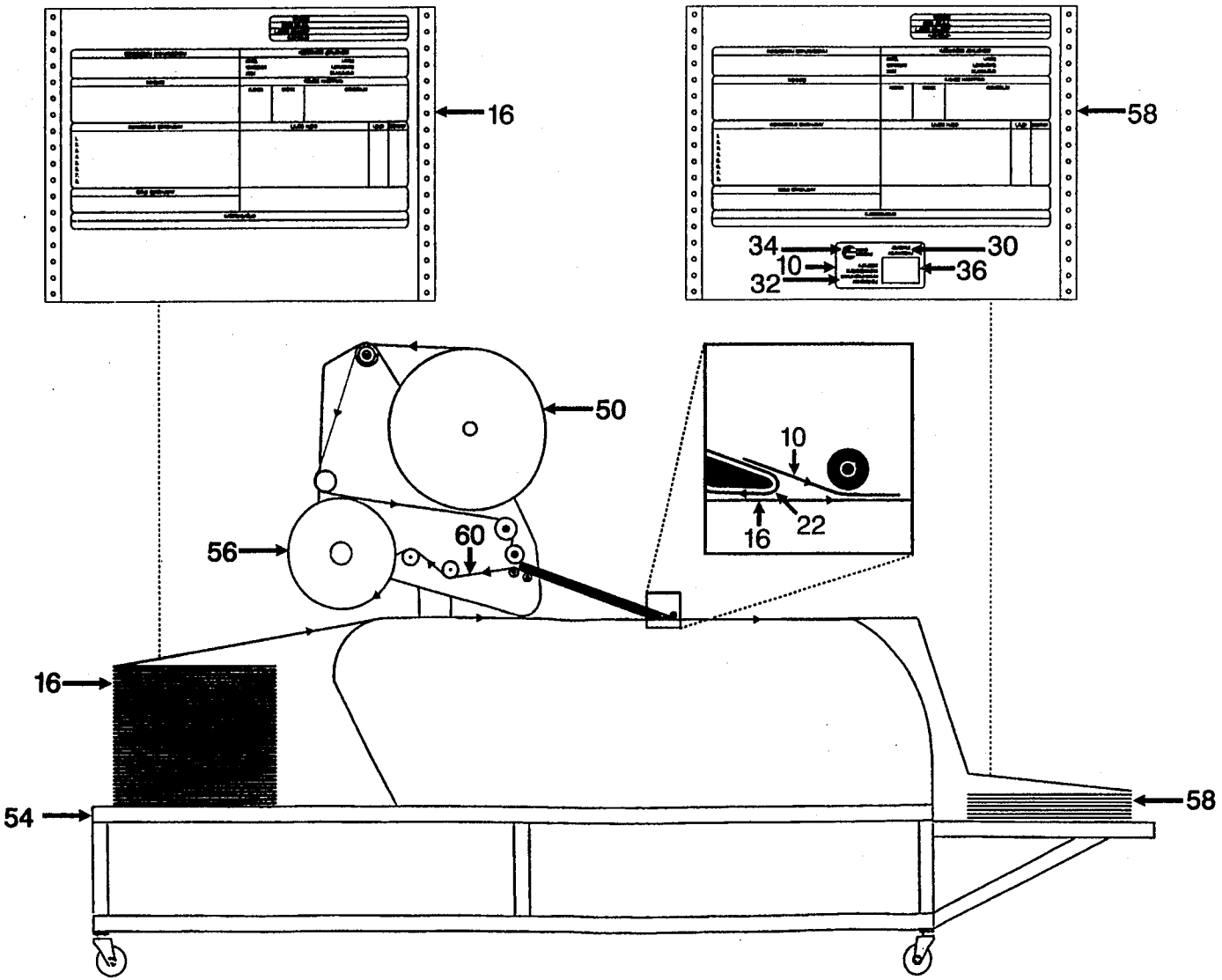

This piggyback vinyl static cling stock 24 is thereafter further manufactured, as shown in the overview of FIG. 2. Thereafter, preprinted and pre-formed piggyback vinyl static cling stock 24 with preprinted service invoice record forms 16 of a service organization, are further manufactured, as illustrated in the overview of FIG. 3. Thereafter, they are effectively and efficiently used by personnel at a service organization, as illustrated in the overview of FIG. 4, upon operating a printer to complete the correct entry of all the correlated service information on both the service invoice record form 16 and the piggyback vinyl static cling label 10, before it is peeled off and placed on a vehicle or equipment which has been serviced.

The Manufacture of the Piggyback Vinyl Static Cling Stock

The manufacture of the piggyback vinyl static cling stock 24, presently is undertaken by a manufacturer that provides stock materials, preferably in rolls, to other manufacturers such as a label manufacturer. Per specifications of the label manufacturer, the piggyback vinyl static cling stock material 24 on the roll 25, is manufactured to length 12 and width 14, as shown in FIG. 1. During the manufacturing, depending on available equipment and facilities, the manufacturer takes from a source of clear vinyl material 18, a so-called first lamination 18, preferably specified as eight millimeters thick and capable of holding an electro-static charge. Then the manufacturer takes from a source of polyester material 20, a so-called second lamination 20, preferably specified as two millimeters thick, capable of receiving and positioning the clear vinyl electro-static charged cling first lamination 18 on its top side, and applies an adhesive coating 21 on its bottom side, and thereafter completes the laminating of the vinyl material 18 to the polyester material 20. Thereafter, the manufacturer takes from a source of paper material 22, often referred to as paper liner material 22, a so-called third lamination 22, preferably specified as a layer of three millimeter paper, and impregnates into the top surface, i.e. contact surface thereof, silicone, which later serves effectively during the release of the polyester material with its adhesive coating from the paper material 22, and thereafter completes the laminating of this paper laminate 22, serving as a carrier, to the combined laminations of the clear vinyl static cling material 18 and the polyester material 20. Thereafter, the completed three lamination piggyback vinyl static cling stock 24 is preferably arranged on a roll 25 for delivery to the label manufacturer.

The Manufacture of the Customer service Information Label by Modifying the Piggyback Vinyl Static Cling Stock The manufacturer, generally a label manufacturer, performs a second manufacturing process, preferably progressively removing the piggyback vinyl static cling stock 24 from a roll 25, as shown in FIG. 1, rather than receiving it directly, and feeding this stock 24 through a manufacturing line, as illustrated in FIG. 2, centering on printing presses and related equipment to modify this stock 24 to create piggyback vinyl static cling customer service information labels 10.

The width 14 of this stock 24 is generally wider in width than piggyback vinyl static cling customer service information labels 10 and the length 12 of this stock 24 is several hundred feet long, and has a thickness which provides for the completion of this manufacturing process and to subsequently provide the serviceability, wearability, and the production and maintenance of the electro-static charge capability to hold the clear vinyl static cling material 18 in place. When the piggyback vinyl static cling stock 24 is fed through this manufacturing line the following multiple operations, combining printing operations and forming step operations, the latter hereinafter referred to as die cutting operations, are undertaken to create the piggyback vinyl static cling customer service information label 10.

The printing operations shown in the overview of FIG. 2 are:

1. printing at designated stations on the printing press 48, using a service organization's: specified colors; organizational information 30; service information descriptions 32; and logo 34, which are located about the area of the vinyl material 18 of the piggyback vinyl static cling customer service information label 10 that is being manufactured as specified in size, location, and content, by personnel of the service organization; and
2. printing a matte copy coat 36, on an area specified as to size and location by personnel of the service organization, on the vinyl material 18 of the piggyback vinyl static cling customer service information label 10 that is being manufactured.

The forming operations shown in the overview of FIG. 2 are:

1. die cutting 38 at a designated station on the printing press 48, to a size and shape, specified by the personnel of the service organization, the piggybacked layers of the vinyl static cling material 18 and also the polyester material 20 having the adhesive coating 21, but not the paper material 22 that is impregnated with silicone 23, creating the right size of the piggyback vinyl static cling customer service information label 10;
2. creating aligned, parallel, longitudinal spaced under cuts 40 and 42, at a designated station on the printing press 48 of the paper material 22, that is impregnated with silicone 23, from underneath the polyester material 20 and the vinyl static cling material 24, so these materials may be removed, to establish a new dimensional width 44 of the remaining paper material 22, thereby continuing to provide a surface of this paper material 29., impregnated with silicone 23, on which the piggyback vinyl static cling customer service information label 10 is carried for subsequent preferable winding into rolls 50 at a designated station on the printing press 48;
3. creating a continuous stream of excess laminated material 46, after the printing, die cutting, and undercutting of the original laminated material 24, consisting of vinyl static cling material 18, the polyester material 20 and the paper material 22;
4. creating a continuous roll 52 at a designated station on the printing press 48, of this continuous stream of excess laminated material 46; and
5. creating a continuous roll 50 at a designated station on this printing press 48 of the printed and die cut piggyback vinyl static cling customer service information labels 10 to be used when mounted on a blow-on machine 54, which also receives the fan folded partially preprinted service organization's service invoice forms arranged for like continuous feed through the blow-on machine 54, as illustrated in the overview of Fig. 3.

The Operation of a Blow-On Machine to Affix the Piggyback Vinyl Static Cling Customer Service Information Label and its Then Polyester Material, Having the Adhesive Coating, to the Partially Printed Service Organization's Service Invoice Form While This Form Remains Under Continuous Feeding By operating a blow-on machine 54, as illustrated in the overview of FIG. 3, the roll 50, mounted on this machine 54, of the piggyback vinyl static cling customer service information labels 10, which are still laminated to the polyester material 20 and paper material 22, are unrolled and pulled through this blow-on machine 54. Per the specifications of the personnel of the service organization, each label 10 is moved to a selected position for being affixed to a respective partially printed service organization's service invoice form 16 which is being continuously fed through this blow-on machine 54.

At this selected position or station on the blow-on machine 54, the paper material 22, with the aid of the impregnated silicone is separated from the adhesive coating 21 on the polyester material 20. Then the piggyback vinyl static cling customer service information label 10 and its polyester material 20 with its adhesive coating 21, by the air pressure created by the blow-on machine 54, is blown into contact with the designated surface area of the preprinted service organization's service invoice form 16, thereby mating this piggyback label 10 with its respective invoice form 16, as this invoice form 16 continues to be continuously fed with other invoice forms 16 through this blow-on machine 54. This combination of the piggyback label 10, with its polyester material 20 adhered to the respective invoice form 16, is then designated as the service organization's partially preprinted customer service invoice form 58, which remains as one of several that are still arranged for continuous feeding and are then fan folded by the blow-on machine 54.

The continuous stream 60 of the then separated paper material 22, with its impregnated silicone 23, via the operation of this blow-on machine, is wound into a roll of waste material 54.

A service organization personnel's specified size of a fan folded stack of the service organization's service invoice forms 58 is thereby created by the blow-on machine 54, for use in a follow on continuous feed operation, and for packaging into a container, not shown, for shipment to a service organization.

The Utilization Operations Performed by the Personnel of the Service Organization After They Receive Their Service Organization's Partially Printed Service Invoice Forms Having the Piggyback Vinyl Static Cling Customer Service Information Labels Affixed Thereto, and Arranged For Continuous Feeding Through the Service Organization's Printer The personnel of the service organization, after receiving the service organization's partially preprinted service invoice forms 58, having the piggyback vinyl static cling customer service information labels 10, with the polyester material 20, adhesively affixed thereto, and arranged for continuous feeding, place a folded stack of them in the service organization's printer 62, as illustrated in the overview of FIG. 4. Then upon demand, when a vehicle 64 or other equipment, not shown, is being serviced, the personnel of the service organization operate the printer 62, to machine print at various locations throughout the service invoice form 58, including the area 36 of the piggyback vinyl static cling customer service information label 10 all the necessary customer service information, that is to be kept for current and later review by the personnel of the service organization and/or the customer.

Then after the service is completed and all the printed entries are completed, a person on the staff of the service organization, as illustrated in the overview view of FIG. 4, using her or his finger or fingers, in a pulling motion, peels away the piggyback vinyl static cling customer service label 10, separating it from its carrier backing, i.e. the polyester material 18, having the adhesive coating 21, so this polyester material 18 remains on the service invoice form 58. Then this person affixes the formerly piggybacked, now freed, vinyl static cling customer service label 10 to any glass substrate or equivalent of the customer's equipment, not shown, or a customer's vehicle 64, for example, on the windshield 66 thereof, for his or her present and future convenient reference, as illustrated in the overview of FIG. 4.

Other Embodiments, Their Materials, Their Sizes, Their Printing, Their Arrangements, Their Handling, Their Uses, Other Organizations, etc.

The personnel of service organizations generally specify the many advantages they wish to gain by their use of these manufactured, partially preprinted vehicle and equipment service organization's service information labels 10. Therefore their sizes, printing, arrangements, handling, and uses will vary.

Any possible changes of materials may only be undertaken if the same product and/or production specifications can still be met. The vinyl static cling material, or its possible substitute, must remain clear enough and must maintain the electrostatic charge. The carrier, such as the polyester, for the vinyl static cling material, must have the surface necessary to maintain the holding of the vinyl static cling material, and must have another surface to receive the proper and effective adhesive coating. The carrier for polyester or like material, which in turn carries the vinyl or like static cling material, must be a paper or paper like material capable of being impregnated with silicone or a like functioning release agent. Moreover, all of these materials must be able to be laminated readily and hold together during the machine processing of this product line. To the extent possible, costs and availability must both be considered while still maintaining the quality of the product line.

The utilization of rolls has been illustrated and described and is preferred based on current suppliers, manufacturers, available manufacturing machinery, printing presses, and other needed equipment, and the customer's printers. However, in the future, for example, the lamination processes might be combined with the printing processes. Also, possibly, the blow-on machine processes might be combined. These combinations would result in the elimination of some of the rolling operations and therefore the elimination of handling the rolls. Yet at the present time, the illustrated and described manufacturing processes are preferred.

This product line was first used by personnel of service organizations that serviced vehicles, primarily for their routine servicing to keep them running very well. The customer, i.e. the operator and/or owner of the vehicle, becomes a conveniently informed cooperating customer by having for his or her quick observation, to be undertaken at any convenient time, the information on the vinyl static cling customer service label 10 placed on glass 66 of the vehicle 64.

This product line is being used by personnel of other service organizations that service other operating equipment which needs routine service and maintenance, and where on the equipment or nearby there is a glass or glass like material on which the vinyl static cling customer service information label may be placed for convenient and frequent observation.

In respect to these uses of the product line and to these yet to be considered uses, there is always the need to accurately mechanically print the information, both on the record kept by the personnel of the organization and the person receiving the services. In any such relationship, where hand printings and writings, often on separate forms or other papers, are now being undertaken, the adoption or selection of this product line could be considered. For example, in the practice of medicine, where drug prescriptions are often hand written, this product line might in the future in some specified format be considered for use during the practice of medicine.

I claim:

1. A manufactured, partially preprinted service invoice record form having a piggyback vinyl static cling customer service information label affixed thereto, comprising:

a. a partially preprinted service invoice record form manufactured to meet specifications of a service organization; and b. a piggyback vinyl static cling customer service information label, comprising, in turn, a top vinyl static cling laminate, a polyester material laminate having a top surface that receives the top vinyl static cling laminate held in place, in the presence of an electrical static charge, and having a bottom surface that receives an adhesive coating used in affixing this piggyback vinyl static cling customer service information label to the partially preprinted service invoice record form.

2. A manufactured, partially preprinted service invoice record form having a piggyback vinyl static cling customer service information label affixed thereto, as claimed in claim 1, comprising additional like manufactured partially preprinted service invoice record forms having a piggyback vinyl static cling customer service information label affixed thereto, arranged in a continuous feed grouping.

3. A manufactured, partially preprinted service invoice record form having a piggyback vinyl static cling customer service information label affixed thereto, as claimed in claim 2, wherein the continuous feed grouping is fan folded.

4. A manufactured piggyback vinyl static cling customer service information label stock comprising:

a. a vinyl static cling material laminate;

b. a polyester material laminate having a top surface receiving the vinyl static cling material laminate, and having a bottom surface coated with an adhesive; and c. a paper material laminate having a top surface impregnated with silicon which is in contact with adhesive which is coated on the bottom surface of the polyester material laminate.

5. A manufactured piggyback vinyl static cling customer service information label stock as claimed in claim 4, arranged in a roll.

6. A manufactured piggyback vinyl static cling customer service information label stock as claimed in claim 4, wherein:

the vinyl static cling material laminate is eight millimeters thick;

the polyester material laminate is two millimeters thick; and the paper material laminate is three millimeters thick.

7. A manufactured piggyback vinyl static cling customer service information label modified stock comprising:

a. vinyl static cling material cut to a designated label size;

b. polyester material cut to a designated label size, matching the label size of the vinyl static cling material having a top surface receiving the vinyl static cling material cut to the designated label size, and having a bottom surface coated with an adhesive; and c. a paper material having a top surface impregnated with silicone which is in contact with the adhesive which is coated on the bottom surface of the polyester material, and this paper material extends in all directions beyond the label size of both the vinyl static cling material and the polyester material thereby serving as a carrier.

8. A manufactured piggyback vinyl static cling customer service information label modified stock, as claimed in claim 7, wherein the paper material is arranged as a long carrier, and wherein both the vinyl static cling material and the polyester material, which are both cut to a designated label size are repeated at spaced intervals along the paper material which is arranged as a long carrier.

9. A manufactured piggyback vinyl static cling customer service information label modified stock, as claimed in claim 8, wherein the paper material arranged as a long carrier and which has both the vinyl static cling materials and the polyester materials arranged in spaced designated label sizes, is arranged on a roll.

10. A manufactured piggyback vinyl static cling customer service information label modified stock, as claimed in claim 7, wherein the vinyl static cling material in the designated label size has the top surface thereof, in part, setting forth printed information per specifications of a service organization, also in part having a matte copy coat for the subsequent receipt of service information.

11. A manufactured piggyback vinyl static cling customer service information label modified stock, as claimed in claim 8, wherein the vinyl static cling material in the designated label size has the top surface thereof, in part, setting forth printed information per specifications of a service organization, also in part having a matte copy coat for the subsequent receipt of service information.

12. A manufactured piggyback vinyl static cling customer service information label modified stock, as claimed in claim 9, wherein the vinyl static cling material in the designated label size has the top surface thereof, in part, setting forth printed information per specifications of a service organization, also in part having a matte copy coat for the subsequent receipt of service information.

13. A method of manufacture of a piggyback vinyl static cling customer service information label by modifying a piggyback vinyl static cling stock having a vinyl static cling material laminate, a polyester material laminate having a top surface holding the vinyl static cling material laminate, and having a bottom surface coated with an adhesive, and a paper material laminate having a top surface impregnated with silicone, which is in contact with the adhesive, which is coated on the bottom surface of the polyester material laminate, comprising:

operating a manufacturing line of equipment performing conveying, printing and forming operations, the latter including die cutting operations, wherein there are steps comprising:

a. printing at designated stations on a printing press, whereby information specified by personnel of a service organization is printed within respective specified areas of respective specified sizes on the vinyl static cling material laminate;

b. printing at a designated station on a printing press, a matte copy coat on an area, specified as to size and location by personnel of a service organization, on the vinyl static cling material laminate;

c. forming by die cutting at a designated station on a printing press to a size and shape, specified by personnel of a service organization, the piggyback laminates of the vinyl static cling material and also the polyester material having the adhesive coating, but not die cutting the paper material laminate that is impregnated with silicone, thereby creating the right size of the piggyback vinyl static cling customer service information label; and d. forming by creating aligned, parallel, longitudinal spaced undercuts, at a designated station on a printing press, of the paper material laminate that is impregnated with silicone, from underneath the polyester material and vinyl static cling material, whereby these materials are removed, thereby establishing a new dimensional width of the remaining paper material laminate, impregnated with silicone, on which the piggyback vinyl static cling customer service information label being manufactured is carried.

14. A method of manufacture of a piggyback vinyl static cling customer service information label, as claimed in claim 13, comprising, in addition, the step of:

creating a continuous stream of excess laminated material, after the printing, die cutting, and undercutting of the original laminated piggyback vinyl static cling stock, consisting of vinyl static cling material laminate, polyester material laminate, and paper material laminate.

15. A method of manufacture of a piggyback vinyl static cling customer service information label, as claimed in claim 14, comprising, in addition, the step of:

creating a continuous roll, at a designated station on a printing press, of the printed and die cut piggyback vinyl static cling customer service information labels.

16. A method of manufacture of a piggyback vinyl static cling customer service information label, as claimed in claim 15, comprising in addition, the step of:

creating a continuous roll, at a designated station on a printing press, of the continuous stream of excess laminated material.

17. A method of manufacture of a combined piggyback vinyl static cling customer service information label and a service organization's partially printed service invoice record form, comprising the steps of:

a. loading a continuous roll of the printed and die cut piggyback vinyl static cling customer service information label as manufactured in accordance with the steps of claim 15, onto a blow-on machine;

b. loading a continuous fan folded pile of a partially printed service organization's service invoice record form onto a blow-on machine;

c. operating the blow-on machine to continuously feed through this blow-on machine the partially printed service organization's service invoice record forms;

d. operating the blow-on machine to continuously feed part way through this blow-on machine the printed and die cut piggyback vinyl static cling customer service information labels, as manufactured in accordance with the steps of claim 15;

e. operating the blow-on machine to separate the combined piggyback vinyl static cling customer service information label, i.e. the vinyl material laminate, and the polyester material laminate with its adhesive coating from the paper material laminate, with the aid of the impregnated silicone; and f. operating the blow-on machine to blow the separated combined piggyback vinyl static cling customer service information label, i.e. the vinyl material laminate, and the polyester material laminate with its adhesive coating, into contact with a designated surface area of a respective service organization's preprinted service invoice form, thereby mating the piggyback vinyl static cling customer service information label with its respective service organization's preprinted service invoice form.

18. A method of manufacture of a combined piggyback vinyl static cling customer service information label and a service organization's partially printed service invoice record form, as claimed in claim 17, comprising the additional step of:

operating the blow-on machine to fan fold the combined piggyback vinyl static cling customer service information label and a service organization's partially printed service invoice record form.

19. A method of utilization of the fan folded combined piggyback vinyl static cling customer service information label and a service organization's partially printed service invoice record form, comprising the steps of:

a. loading the fan folded combined piggyback vinyl static cling customer service information label and a service organization's partially printed service invoice record form onto a printer located at the service organization;

b. operating the printer to mechanically print information concerning the services performed both on the piggyback vinyl static cling customer service information label, and on the service organization 's partially printed service record form;

c. peeling the piggyback vinyl static cling customer service information label from the underlying polyester, which remains on the service organization's then fully printed service record form; and d. applying the piggyback vinyl static cling customer service information label to a glass or a glass like surface of a vehicle or equipment that has been serviced.

* * * * *